US009508288B2

(12) United States Patent
Kim et al.

(10) Patent No.: US 9,508,288 B2
(45) Date of Patent: Nov. 29, 2016

(54) ORGANIC LIGHT EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Min-Cheol Kim, Yongin (KR); In-Hwan Kim, Yongin (KR); Byung-Geun Jun, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/558,934

(22) Filed: Dec. 3, 2014

(65) Prior Publication Data

US 2015/0170570 A1 Jun. 18, 2015

(30) Foreign Application Priority Data

Dec. 17, 2013 (KR) ..... 10-2013-0156999

(51) Int. Cl.
*G09G 3/30* (2006.01)
*G09G 3/32* (2016.01)

(52) U.S. Cl.
CPC ..... *G09G 3/3258* (2013.01); *G09G 3/3266* (2013.01); *G09G 2300/0819* (2013.01); *G09G 2300/0861* (2013.01); *G09G 2310/0262* (2013.01); *G09G 2320/043* (2013.01)

(58) Field of Classification Search
CPC .. G09G 3/3233; G09G 3/325; G09G 3/3258; G09G 2320/043
See application file for complete search history.

(56) References Cited

U.S. PATENT DOCUMENTS

2005/0179627 A1 8/2005 Hayafuji et al.
2006/0145967 A1 7/2006 Huh
2009/0066617 A1* 3/2009 Chang ..... G09G 3/3233 345/83
2010/0117937 A1 5/2010 Kim et al.
2011/0025659 A1* 2/2011 Kwak ..... G09G 3/3233 345/205
2011/0273429 A1* 11/2011 Choi ..... G09G 3/3225 345/212

FOREIGN PATENT DOCUMENTS

KR 10-2006-0078427 A 7/2006
KR 10-2010-0053345 A 5/2010

* cited by examiner

*Primary Examiner* — Quan-Zhen Wang
*Assistant Examiner* — Xuemei Zheng
(74) *Attorney, Agent, or Firm* — Lee & Morse P.C.

(57) ABSTRACT

There is provided an organic light emitting display device and a method of driving the same. The organic light emitting display device includes pixels, a data driver, a scan driver to sequentially supply scan signals to scan lines, and a control line driver configured to supply emission control signals to emission control line. The data driver is to discharge the gate electrodes of the driving transistors of the pixels at a uniform discharge speed in a third period within a second period, wherein the second period is after the first period, the third period corresponds to a light emitting gray scale of each pixel, and after the second period, the pixels emit light.

14 Claims, 3 Drawing Sheets

ORGANIC LIGHT EMITTING DISPLAY DEVICE AND METHOD OF DRIVING THE SAME

CROSS-REFERENCE TO RELATED APPLICATION

Korean Patent Application No. 10-2013-0156999, filed on Dec. 17, 2013, in the Korean Intellectual Property Office, and entitled: "ORGANIC LIGHT EMITTING DISPLAY DEVICE AND METHOD OF DRIVING THE SAME," is incorporated by reference herein in its entirety.

BACKGROUND

1. Field

Embodiments relate to an organic light emitting display device and a method of driving the same.

2. Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting display devices.

Among the FPDs, the organic light emitting displays display images using organic light emitting diodes (OLED) that generate light by re-combination of electrons and holes. The organic light emitting display has high response speed and is driven with low power consumption.

SUMMARY

An organic light emitting display device according to an embodiment includes pixels, a data driver, a scan driver configured to sequentially supply scan signals to scan lines, and a control line driver configured to supply emission control signals to emission control lines. Each pixel includes a driving transistor, gate electrodes of driving transistors being charged by a reference voltage applied through first and second electrodes of the driving transistors in a first period. The data driver to discharge the gate electrodes of the driving transistors of the pixels at a uniform discharge speed in a third period within a second period, wherein the second period is after the first period, the third period corresponds to a light emitting gray scale of each pixel, and after the second period, the pixels emit light;

The data driver may include a pulse width modulation (PWM) signal generator configured to generate PWM signals corresponding to the pixels in response to image data, a current sink unit configured to sink uniform reference current, and a switching transistor turned on in response to the PWM signals to connect the current sink unit and data lines corresponding to the pixels.

Each pixel may include an organic light emitting diode (OLED) and a pixel circuit configured to control current that flows from a first power source to a second power source through the OLED.

The pixel circuit may include a second transistor connected between a reference voltage source configured to supply the reference voltage and the first electrode of the driving transistor and turned on when the scan signal is supplied to a previous scan line among the scan lines, a third transistor connected between the gate electrode and second electrode of the driving transistor and turned on when the scan signal is supplied to the previous scan line, a fourth transistor connected between a data line and the gate electrode of the driving transistor and turned on when the scan signal is supplied to a current scan line among the scan lines, a fifth transistor connected between the first power supply and the first electrode of the driving transistor and turned on when the emission control signal is supplied to the emission control line, and a sixth transistor connected between the second electrode of the driving transistor and an anode electrode of the OLED and turned on when the emission control signal is supplied to the emission control line.

The pixel circuit may further include a storage capacitor connected between the first power source and the gate electrode of the driving transistor.

The first period may be a period in which the scan signal is supplied to the previous scan line and the second period may be a period in which the scan signal is supplied to the current scan line.

The emission control signal may not be supplied to the emission control line in the first and second periods.

The first electrode of the driving transistor may be connected to the second transistor and the fifth transistor, the second electrode may be connected to the third transistor and the sixth transistor, and the gate electrode may be connected to the third transistor and the fourth transistor.

The reference voltage may be higher than a voltage of the first power source.

The driving transistor may be diode-connected in the first period.

A method of driving an organic light emitting display device according to the embodiment includes applying a reference voltage to gate electrodes through first and second electrodes of driving transistors of pixels to charge the gate electrodes, discharging the gate electrodes of the driving transistors at a uniform discharge speed in a discharge period corresponding to a light emitting gray scale of each pixels, and supplying currents corresponding to voltages of the gate electrodes of the driving transistors from a first power source to a second power source through OLEDs.

Discharging the gate electrodes of the driving transistors at a uniform discharge speed in a discharge period corresponding to a light emitting gray scale of each pixels includes generating PWM signals having pulse widths corresponding to the light emitting gray scales and sinking uniform reference current from the gate electrodes in response to the PWM signals.

The reference voltage may be applied in a first period where scan signals are supplied through previous scan lines of the pixels and the uniform reference current may be sunken in the discharge period in a second period where the scan signals are supplied through current scan lines of the pixels.

The reference voltage may be higher than a voltage of the first power source.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
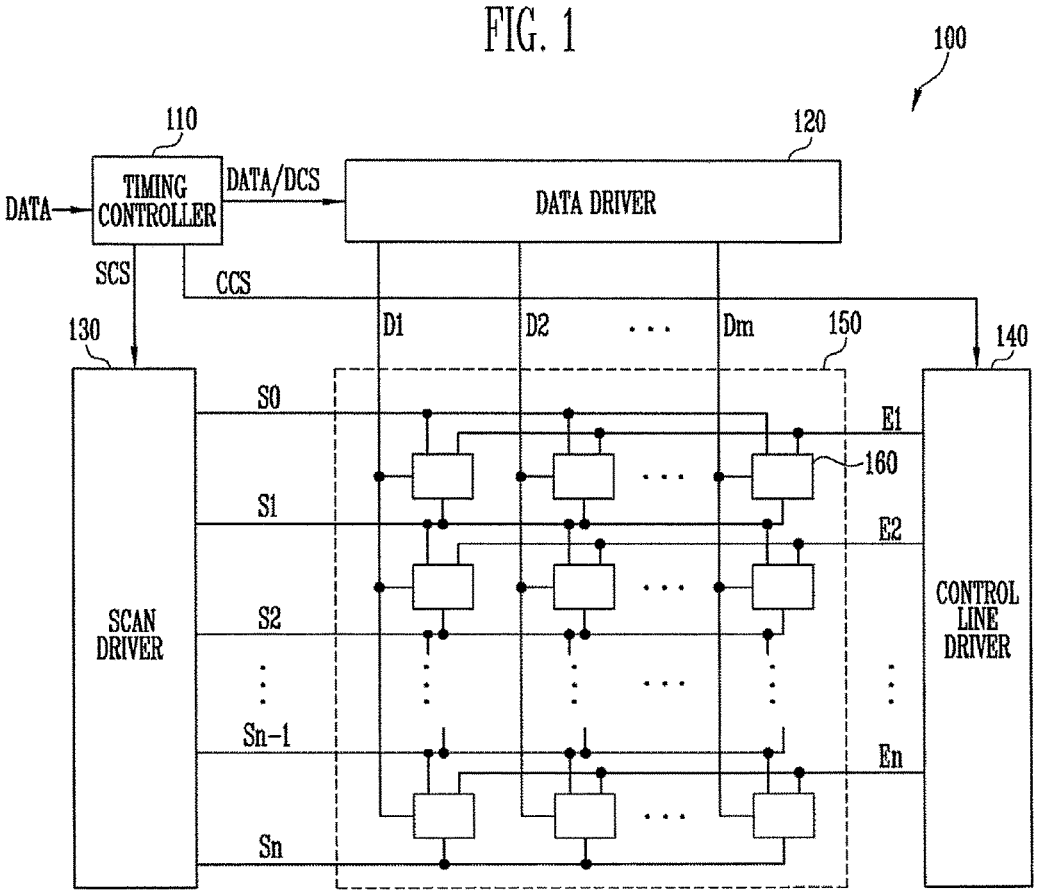
FIG. 1 illustrates a block diagram of an organic light emitting display device according to an embodiment.

FIG. 1 illustrates a block diagram of an organic light emitting display device according to an embodiment. Referring to FIG. 1, an organic light emitting display device 100 includes a timing controller 110, a data driver 120, a scan driver 130, a control line driver 140, and a display unit 150.

The timing controller 110 controls operations of the data driver 120, the scan driver 130, and the control line driver 140 in response to a synchronizing signal (not shown) supplied from the outside. Specifically, the timing controller 110 generates a data driving control signal DCS to supply the generated data driving control signal DCS to the data driver 120. The timing controller 110 generates a scan driving control signal SCS to supply the generated scan driving control signal SCS to the scan driver 130. The timing controller 110 generates a control line driving control signal CCS to supply the generated control line driving control signal CCS to the control line driver 140.

In addition, the timing controller 110 supplies image data DATA supplied from the outside to the data driver 120.

The data driver 120 is synchronized with the scan driver 130 and the control line driver 140 in response to the data driving control signal DCS output from the timing controller 110.

The data driver 120 sinks uniform reference current (Iref of FIG. 2) by a discharge period, i.e., a third period (T3 of FIG. 4) corresponding to a light emitting gray scales of each pixel 160 through corresponding data lines D1 to Dm in accordance with the image data DATA supplied from the timing controller 110.

That is, the data driver 120 discharges gate electrodes of driving transistors of the pixels 160 at a uniform discharge speed in the third period T3. Specifically, the data driver 120 generates pulse width modulation (PWM) signals (PWM1 to PWMm of FIG. 2) corresponding to the data lines D1 to Dm in response to the image data DATA and sinks the reference current Iref from the pixels 160 by a period corresponding to the generated PWM signals PWM1 to PWMm.

Figure 2:
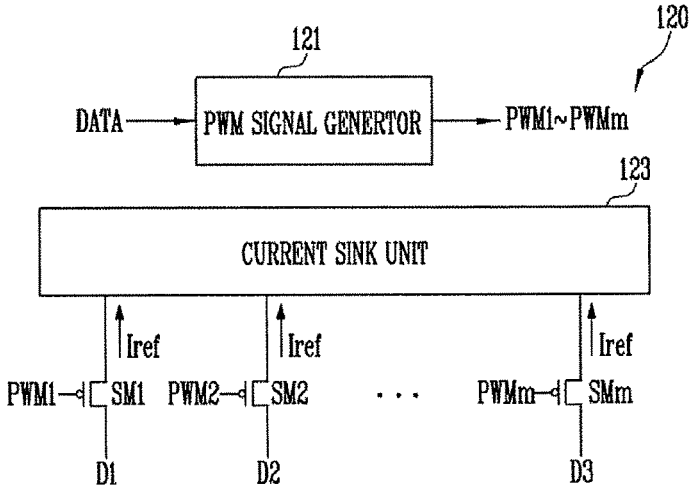
FIG. 2 illustrates a block diagram of the data driver of FIG. 1, in detail.

FIG. 2 is a view illustrating the data driver of FIG. 1 in detail. Referring to FIG. 2, the data driver 120 includes a PWM signal generator 121, a current sink unit 123, and switching transistors SM1 to SMm.

The PWM signal generator 121 generates the PWM signals PWM1 to PWMm corresponding to the data lines D1 to Dm in response to the image data DATA supplied from the timing controller 110. The PWM signal generator 121 supplies the generated PWM signals PWM1 to PWMm to the switching transistors SM1 to SMm.

For example, when a scan signal is supplied to an nth scan line Sn, the PWM signal generator 121 generates the PWM signals PWM1 to PWMm having pulse widths corresponding to the light emitting gray scales of the pixels 160 connected to the nth scan line Sn.

The current sink unit 123 sinks the uniform reference current Iref from the data lines D1 to Dm when the switching transistors SM1 to SMm are turned on. Each of the switching transistors SM1 to SMm is turned on in response to one of the PWM signals PWM1 to PWMm. That is, each of the switching transistors SM1 to SMm connects one of the data lines D1 to Dm to the current sink unit 123 in response to one of the PWM signals PWM1 to PWMm.

The scan driver 130 sequentially supplies scan signals to scan lines S0 to Sn in response to the scan driving control signal SCS output from the timing controller 110.

The control line driver 140 sequentially supplies emission control signals to emission control lines E1 to En in response to the control line driving control signal CCS output from the timing controller 110.

According to the present specification, that a control signal, for example, a scan signal or an emission control signal is supplied indicates that a pulse of a voltage level at which a transistor, to which the control signal is supplied, is turned on is supplied. For example, when the transistor is a p-type metal oxide semiconductor (PMOS), that the control signal is supplied indicates that a pulse at a low level is supplied.

Operations of the data driver 120, the scan driver 130, and the control line driver 140 will be described in detail with reference to FIGS. 3 and 4.

The display unit 150 includes the pixels 160 arranged at intersections of the data lines D1 to Dm, the scan lines S0 to Sn, and the emission control lines E1 to En. Here, the data lines D1 to Dm are vertically arranged and the scan lines S0 to Sn and the emission control lines E1 to En are horizontally arranged.

The pixels 160 are connected to corresponding data lines among the data lines D1 to Dm, two corresponding scan lines among the scan lines S0 to Sn, and corresponding emission control lines among the emission control lines E1 to En.

Each of the pixels 160 applies a reference voltage Vref to a gate electrode through a first electrode and a second electrode of a driving transistor (M1 of FIG. 3) included in each of the pixels 160 in a first period (T1 of FIG. 4) to charge the gate electrode.

According to the present specification, 'the first electrode' means one of a source electrode and a drain electrode and 'the second electrode' means the other of the source electrode and the drain electrode.

Figure 4:
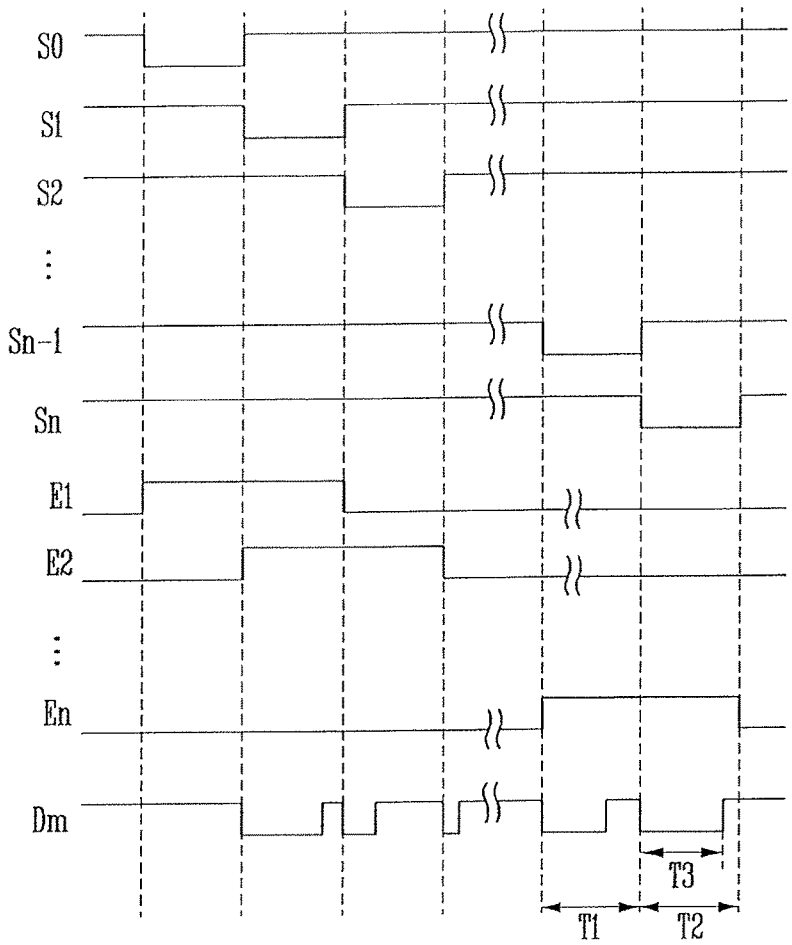
FIG. 4 illustrates a timing diagram of control signals for describing an operation of the organic light emitting display device of FIG. 1.

The gate electrode of the driving transistor M1 of each of the pixels 160 is discharged at a uniform discharge speed in a third period T3 corresponding to the light emitting gray scales of the pixels 160 in a second period T2 of FIG. 4 after the first period T1.

Each of the pixels 160 emits light with brightness corresponding to a voltage charged in the gate electrode of the driving transistor M1 after the second period T2.

Figure 3:
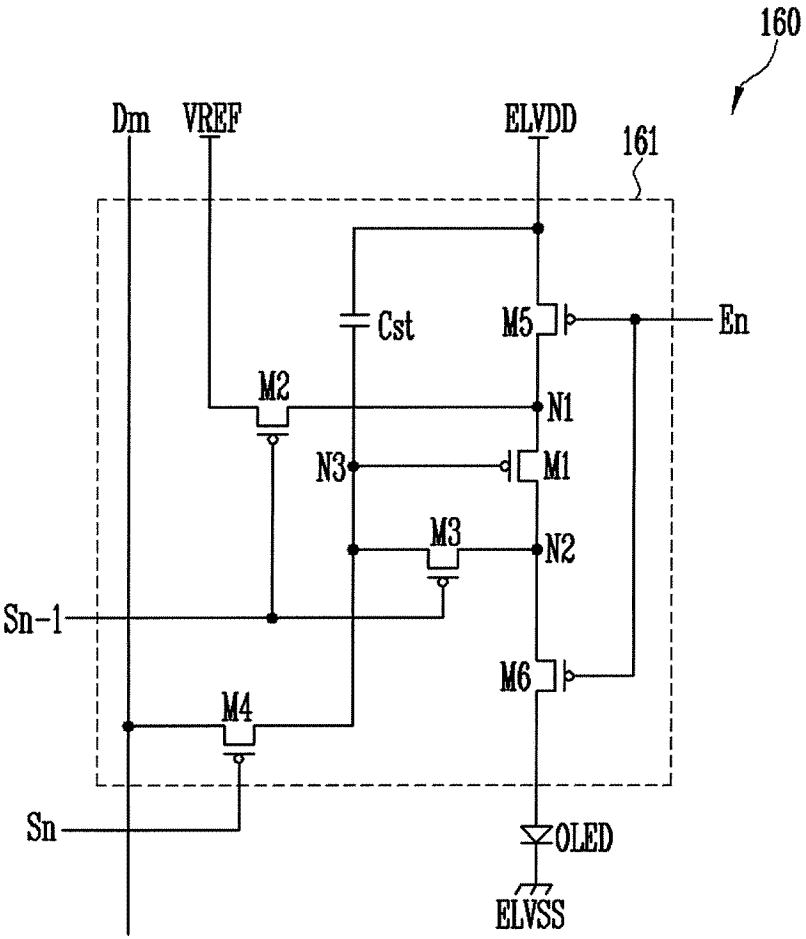
FIG. 3 illustrates a schematic diagram of the pixel of FIG. 1, in detail.
Figure 5:
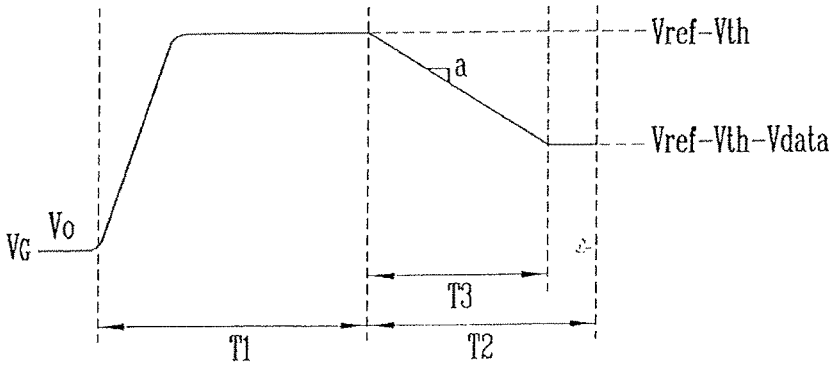
FIG. 5 is a graph illustrating a change in a voltage of a gate electrode of a driving transistor of the pixel of FIG. 2.

FIG. 3 is a view illustrating the pixel of FIG. 1 in detail. FIG. 4 is a timing diagram of control signals for describing an operation of the organic light emitting display device of FIG. 1. FIG. 5 is a graph illustrating a change in a voltage of a gate electrode of a driving transistor of the pixel of FIG. 2.

Referring to FIGS. 3 to 5, the pixel 160 includes an organic light emitting diode (OLED) and a pixel circuit 161.

The OLED is coupled between the pixel circuit 161 and a second power source ELVSS. The OLED emits light with a brightness corresponding to current supplied from the first power source ELVDD through the pixel circuit 161.

The pixel circuit 161 is coupled between the first power source ELVDD and an anode electrode of the OLED. The pixel circuit 161 controls the current that flows from the first power source ELVDD to the second power source ELVSS through the OLED OLED in response to control signals supplied from the previous scan line Sn-1, the current scan line Sn, and the emission control line En.

According to the present specification, the previous scan line Sn-1 means a scan line to which a scan signal is supplied earlier than the other scan lines among the scan lines connected to the pixel 160, for example, Sn-1 and Sn in FIG. 3. In contrast, the current scan line Sn means a scan line to which a scan signal is supplied later than the other scan lines among the scan lines connected to the pixel 160.

The pixel circuit 161 may include a plurality of transistors M1 to M6 and a storage capacitor Cst.

The driving transistor, i.e., the first transistor M1 is connected between a first node N1 between a second transistor M2 and a fifth transistor M5 and a second node N2 between a third transistor M3 and a sixth transistor M6. In particular, a first electrode of the driving transistor M1 is connected to the first node N1, a second electrode of the driving transistor M1 is connected to the second node N2, and a gate electrode of the driving transistor M1 is connected to a third node N3 among the storage capacitor Cst, the third transistor M3, and the fourth transistor M4.

The second transistor M2 is connected between a reference voltage source VREF and the first electrode of the first transistor M1. The second transistor M2 is turned on when the scan signal is supplied through the previous scan line Sn-1. In particular, a first electrode of the second transistor M2 is connected to the reference voltage source VREF, a second electrode of the second transistor M2 is connected to the first node N1, and a gate electrode of the second transistor M2 is connected to the previous scan line Sn-1.

The third transistor M3 is connected between the gate electrode and the second electrode of the driving transistor M1, and is turned on when the scan signal is supplied through the previous scan line Sn-1. In particular, a first electrode of the third transistor M3 is connected to the third node N3, a second electrode of the third transistor M3 is connected to the second node N2, and a gate electrode of the third transistor M3 is connected to the previous scan line Sn-1.

The fourth transistor M4 is connected between the data line Dm and the gate electrode of the driving transistor M1, and is turned on when a scan signal is supplied through the current scan line Sn. In particular, a first electrode of the fourth transistor M4 is connected to the data line Dm, a second electrode of the fourth transistor M4 is connected to the third node N3, and a gate electrode of the fourth transistor M4 is connected to the current scan line Sn.

The fifth transistor M5 is connected between the first power source ELVDD and the first electrode of the driving transistor M1, and is turned on when the emission control signal is supplied through the emission control line En. In particular, a first electrode of the fifth transistor M5 is connected to the first power source ELVDD, a second electrode of the fifth transistor M5 is connected to the first node N1, and a gate electrode of the fifth transistor M5 is connected to the emission control line En.

The sixth transistor M6 is connected between the second electrode of the driving transistor M1 and the anode electrode of the OLED. The sixth transistor M6 is turned on when the emission control signal is supplied through the emission control line En. In particular, a first electrode of the sixth transistor M6 is connected to the second node N2, a second electrode of the sixth transistor M6 is connected to the anode electrode of the OLED, and a gate electrode of the sixth transistor M6 is connected to the emission control line En.

The storage capacitor Cst is connected between the first power source ELVDD and the gate electrode of the driving transistor M1. In particular, a first end of the storage capacitor Cst is connected to the first power source ELVDD and a second end of the storage capacitor Cst is connected to the gate electrode of the driving transistor M1.

The scan driver 130 supplies the scan signal to the previous scan line Sn-1 in the first period T1 and supplies the scan signal to the current scan line Sn in the second period T2. The control line driver 140 does not supply the emission control signal to the emission control line En in the first and second periods T1 and T2.

According to the present specification, 'the first period T1' refers to a period in which the scan signal is supplied to the previous scan line Sn-1 and 'the second period T2' refers to a period in which the scan signal is supplied to the current scan line Sn. Since the scan driver 130 sequentially supplies the scan signals to the scan lines S1 to Sn, and the scan lines S1 to Sn are horizontally arranged, the pixels arranged in the same row simultaneously perform operations in the first period T1 or the second period T2.

In the first period T1, the scan signal is supplied to the previous scan line Sn-1 and the emission control signal is not supplied to the emission control line En. Therefore, the fourth transistor M4, the fifth transistor M5, and the sixth transistor M6 are turned off. However, since the scan signal to the previous scan line Sn-1 the previous scan is supplied to the second and third transistors, the second transistor M2 and the third transistor M3 are turned on.

Since the second transistor M2 is turned on, a reference voltage Vref is applied from the reference voltage source VREF. Since the third transistor M3 is turned on, the driving transistor M1 is diode-connected.

Since the driving transistor M1 is diode-connected, a voltage $V_G$ of the gate electrode of the driving transistor M1 is charged as defined in the following EQUATION 1 in the first period T1.

$$V_G = V\text{ref} - Vth \qquad \text{EQUATION 1}$$

In EQUATION 1, Vth is a threshold voltage of the driving transistor M1.

In the second period T2, the scan signal is supplied to the current scan line Sn and the emission control signal is not supplied to the emission control line En.

Therefore, the fourth transistor M4 is turned on, and the second transistor M2, the third transistor M3, the fifth transistor M5, and the sixth transistor M6 are turned off.

Since the fourth transistor M4 is turned on, the gate electrode of the driving transistor M1 is connected to the data line Dm. The data driver 120 sinks the reference current Iref in the third period T3 corresponding to the light emitting gray scale of each pixel 160 from the corresponding data line Dm. The voltage $V_G$ of the gate electrode of the driving transistor M1 is discharged by the sunken reference current Iref at a uniform discharge speed in the third period T3. In other words, the storage capacitor Cst is discharged at a uniform discharge speed during the third period in accordance with the signal on the data line Dm, so that data written to the pixel is completed.

The voltage $V_G$ of the gate electrode of the driving transistor M1 is discharged in the second period T2 as defined by EQUATION 2.

$$V_G = V\text{ref} - Vth - V\text{data} \qquad \text{EQUATION 2}$$

In EQUATION 2, Vdata is a magnitude of a voltage discharged in the third period T3. Since the third period T3 corresponds to the light emitting gray scale of the pixel 160, Vdata corresponds to the light emitting gray scale of the pixel 160.

After the second period T2, the scan signals are not supplied to the previous scan line Sn-1 and the current scan line Sn, and the emission control signal is supplied to the emission control line En. Therefore, the fifth transistor M5 and the sixth transistor M6 are turned on, and the second transistor M2, the third transistor M3, and the fourth transistor M4 are turned off.

At this time, current I that flows from the first power source ELVDD to the second power source ELVSS through the driving transistor M1 and the OLED is as defined in EQUATION 3 .

$$I=k\cdot(\mathrm{ELVDD}-(V\mathrm{ref}-Vth=V\mathrm{data})-Vth)^2 \qquad \text{EQUATION 3}$$

Accordingly, the threshold voltage Vth of the driving transistor M1 may be offset.

Therefore, the OLED may emit light with correct gray scale regardless of the threshold voltage Vth of the driving transistor M1.

By way of summation and review, a conventional organic light emitting display device may not display an image with correct brightness due to threshold voltages of driving transistors included in pixels.

In contrast, in the organic light emitting display device according to an embodiment and the method of driving the same, an image with correct brightness may be displayed regardless of the threshold voltages of the driving transistors of the pixels.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device, comprising:

pixels, each pixel including a driving transistor, gate electrodes of driving transistors being initially charged by a reference voltage through current paths formed between first electrodes of the driving transistors and second electrodes of the driving transistors in a first period;

a data driver including a current sink, the data driver to discharge the initially charged gate electrodes of the driving transistors of the pixels at a constant discharge speed by the current sink in a third period within a second period, wherein:

the second period is after the first period, a length of the third period corresponds to a light emitting gray scale of each pixel, and the pixels emit light after the second period;

a scan driver to sequentially supply scan signals to scan lines; and a control line driver to supply emission control signals to emission control lines, wherein the current sink has a constant sinking current in the third period.

2. The organic light emitting display device as claimed in claim 1, wherein the data driver comprises:

a pulse width modulation (PWM) signal generator to generate PWM signals supplied to the pixels, the PWM signals having pulse widths corresponding to image data supplied to the data driver; and switching transistors turned on during the pulse widths of the PWM signals to connect the current sink and data lines corresponding to the pixels.

3. The organic light emitting display device as claimed in claim 1, wherein each pixel comprises:

an organic light emitting diode (OLED); and a pixel circuit to control a current that flows from a first power source to a second power source through the OLED.

4. The organic light emitting display device as claimed in claim 3, wherein the pixel circuit comprises:

a second transistor connected between a reference voltage source to supply the reference voltage and the first electrode of the driving transistor, the second transistor being turned on when a previous scan signal of the scan signals is supplied to a previous scan line among the scan lines;

a third transistor connected between the gate electrode and the second electrode of the driving transistor, the third transistor being turned on when the previous scan signal is supplied to the previous scan line;

a fourth transistor connected between a data line and the gate electrode of the driving transistor, the fourth transistor being turned on when a current scan signal of the scan signals is supplied to a current scan line among the scan lines;

a fifth transistor connected between the first power supply and the first electrode of the driving transistor, the fifth transistor being turned on when an emission control signal is supplied to an emission control line; and a sixth transistor connected between the second electrode of the driving transistor and an anode electrode of the OLED, the sixth transistor being turned on when the emission control signal is supplied to the emission control line.

5. The organic light emitting display device as claimed in claim 4, wherein the pixel circuit further comprises a storage capacitor connected between the first power source and the gate electrode of the driving transistor.

6. The organic light emitting display device as claimed in claim 4, wherein the first period is a period in which the previous scan signal is supplied to the previous scan line, and wherein the second period is a period in which the current scan signal is supplied to the current scan line.

7. The organic light emitting display device as claimed in claim 4, wherein the emission control signal is not supplied to the emission control line in the first and second periods.

8. The organic light emitting display device as claimed in claim 4, wherein the first electrode of the driving transistor is connected to the second transistor and the fifth transistor, wherein the second electrode of the driving transistor is connected to the third transistor and the sixth transistor, and wherein the gate electrode of the driving transistor is connected to the third transistor and the fourth transistor.

9. The organic light emitting display device as claimed in claim 3, wherein the reference voltage is higher than a voltage of the first power source.

10. The organic light emitting display device as claimed in claim 1, wherein the driving transistor is diode-connected in the first period.

11. A method of driving an organic light emitting display device, the method comprising:

applying a reference voltage to gate electrodes of driving transistors through current paths formed between first electrodes of the driving transistors and second electrodes of the driving transistors of pixels to initially charge the gate electrodes;

discharging the initially charged gate electrodes of the driving transistors at a constant discharge speed by a current sink in a discharge period, a length of the discharge period corresponding to a light emitting gray scale of each pixel; and supplying currents corresponding to voltages of the discharged gate electrodes of the driving transistors from a first power source to a second power source through OLEDs, wherein the current sink has a constant sinking current in the discharge period.

12. The method as claimed in claim 11, wherein discharging the gate electrodes of the driving transistors at a uniform discharge speed in a discharge period corresponding to a light emitting gray scale of each pixel comprises:

generating PWM signals having pulse widths corresponding to the light emitting gray scales; and sinking the constant sinking current from the initially charged gate electrodes during the pulse widths of the PWM signals.

13. The method as claimed in claim 12, wherein the reference voltage is applied in a first period in which a previous scan signals is supplied through a previous scan line of each pixel, and wherein the constant sinking current is sunken in the discharge period in a second period in which a current scan signal is supplied through a current scan line of each pixel.

14. The method as claimed in claim 11, wherein the reference voltage is higher than a voltage of the first power source.

* * * * *